US011401834B2

(12) United States Patent
James et al.

(10) Patent No.: US 11,401,834 B2
(45) Date of Patent: Aug. 2, 2022

(54) METHOD OF SECURING A CERAMIC MATRIX COMPOSITE (CMC) COMPONENT TO A METALLIC SUBSTRUCTURE USING CMC STRAPS

(71) Applicant: Siemens Energy Global GmbH & Co. KG, Munich (DE)

(72) Inventors: Allister William James, Chuluota, FL (US); Jan H. Marsh, Orlando, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/629,628

(22) PCT Filed: Aug. 1, 2019

(86) PCT No.: PCT/US2019/044571
§ 371 (c)(1),
(2) Date: Jan. 24, 2022

(87) PCT Pub. No.: WO2021/021206
PCT Pub. Date: Feb. 4, 2021

(65) Prior Publication Data

US 2022/0205368 A1 Jun. 30, 2022

(51) Int. Cl.
*F01D 25/24* (2006.01)

(52) U.S. Cl.
CPC ..... *F01D 25/246* (2013.01); *F05D 2230/60* (2013.01); *F05D 2240/14* (2013.01); *F05D 2260/31* (2013.01); *F05D 2300/6033* (2013.01)

(58) Field of Classification Search
CPC ..... F01D 25/246; F01D 9/041; F01D 9/042; F01D 5/282; F01D 5/284; F05D 2230/60; F05D 2230/64; F05D 2230/50211; F05D 2230/50212
See application file for complete search history.

(56) References Cited

U.S. PATENT DOCUMENTS

2007/0031258 A1 2/2007 Campbell et al.
2010/0104426 A1 4/2010 Keller et al.

OTHER PUBLICATIONS

PCT International Search Report and Written Opinion of International Searching Authority dated Mar. 12, 2020 corresponding to PCT International Application No. PCT/US2019/044571 filed Aug. 1, 2019.

*Primary Examiner* — Woody A Lee, Jr.
*Assistant Examiner* — Cameron A Corday

(57) ABSTRACT

A method for attaching a first component composed of a ceramic matrix composite (CMC) to a second component composed of a metallic substructure is provided. The first component comprises at least two slots formed within a body of the first component and a configured to accommodate a thickness of a continuous CMC strap. The ends of the CMC strap are inserted into respective slots in the first component and then inserted into corresponding slots in a second component. The ends are secured to the second component by a fastening means thus securing the first component to the second component.

19 Claims, 3 Drawing Sheets

METHOD OF SECURING A CERAMIC MATRIX COMPOSITE (CMC) COMPONENT TO A METALLIC SUBSTRUCTURE USING CMC STRAPS

BACKGROUND

1. Field

Aspects of the disclosure generally relate to attaching a ceramic matrix composite (CMC) component to a metallic substructure and more particularly to a method of securing a CMC component to a metallic substructure of a turbine component using CMC straps.

2. Description of the Related Art

Gas turbines comprise a casing or cylinder for housing a compressor section, a combustion section, and a turbine section. High efficiency of a gas turbine is achieved by heating the gas flowing through the combustion section to as high a temperature as is practical. However, the hot gas may degrade various metal turbine components, such as the combustor, transition ducts, vanes, ring segments, and turbine blades as it flows through the turbine.

High temperature resistant ceramic matrix composite (CMC) materials have been developed and are increasingly utilized in gas turbine engines. Typically, CMC materials include a ceramic matrix material, which is reinforced with a plurality of reinforcing ceramic fibers or ceramic particles. The fibers may have predetermined orientations(s) to provide the CMC materials with additional mechanical strength. In addition, the composites may be in the form of a laminate formed of a plurality of laminar layers. However, the interlaminar strength of composites comprising laminar layers has been weak. While CMC materials perform better at higher temperatures than metallic alloys, thereby making them potentially very valuable for implementation into gas turbines, the mechanical strength of CMC material (particularly the interlaminar strength as discussed above) is notably less than that of corresponding high temperature superalloy materials. Superalloys are stronger and more ductile, making such metal materials better for supporting components, such as vane carriers, casings, bolting, etc.

To utilize the separate advantages of CMC materials and metal materials, the materials may be attached or otherwise connect to form a hybrid component. For example, turbine components may utilize metallic materials, in particular superalloy materials, as a support structure having a CMC covering which acts as a heat shield to protect the underlying support structure. Generically, the CMC material provides thermal protection while the metallic support structure provides the strength. One issue, however, with utilizing different materials is that the materials may have vastly different thermal properties such as different coefficients of thermal expansion with the result that the materials expand at different rates. When these different materials are attached to one another in such an arrangement as having a metallic substructure with a CMC covering, any movement between the two materials due to the materials expanding at different rates may damage or even destroy the CMC material.

The hybrid approach (CMC with metallic substructure) for turbine components is not currently well established, with many different approaches having been tried and evaluated. For example, turbine vanes have been manufactured as both integral components (the airfoil being integral with the shroud) and modular (the airfoil is separate from the shroud). In the case of modular components, an approach for attaching the airfoil to the shroud involves utilizing metallic side rails to secure the edge of the CMC shrouds to the underlying metallic substructure. A major disadvantage of this design is that the metallic side rails are exposed to the hot gas path with the potential for rapid oxidation or melting of the metal rails and ultimately the failure of the attachment arrangement. Consequently, an improved attachment arrangement for attaching CMC materials to a metallic substructure as well as a method for securing CMC components to underlying metallic substructures are desired.

SUMMARY

Briefly described, aspects of the present disclosure relate to a method for attaching a ceramic matrix composite component to a metallic support structure, an attachment method, and an attachment arrangement between a first gas turbine component and a second gas turbine component are disclosed.

A first aspect of the present disclosure provides a method for attaching a first component comprising a CMC material to a second component comprising a metallic substructure. The method includes utilizing a continuous CMC strap having at least two ends to secure the first component to the second component. Each end is inserted into a respective slot within the first component. Then the ends may be inserted into a further slot within a second component to an attachment point. The two ends are secured within the slots by securing the ends to the second component, thus securing the first component to the second component.

A second aspect of the present disclosure provides an attachment arrangement between a first turbine component and a second turbine component. The second turbine component has a greater coefficient of thermal expansion relative to the first turbine component. A continuous strap includes at least two ends and has the same coefficient of thermal expansion as the first component. The at least two ends are retained within a respective slot in the first turbine component and within a respective second slot in the second turbine component securing the first turbine component to the second turbine component.

A third aspect of the present disclosure provides an attachment method. A continuous strap comprising a CMC material having at least two ends is utilized for attaching a first component to a second component. Each end is inserted into a respective slot in the first component. Each end is then inserted into a further respective second slot within the second component. The ends are secured to the second component with a fastening means. The second component has a greater coefficient of thermal expansion relative to the first component.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
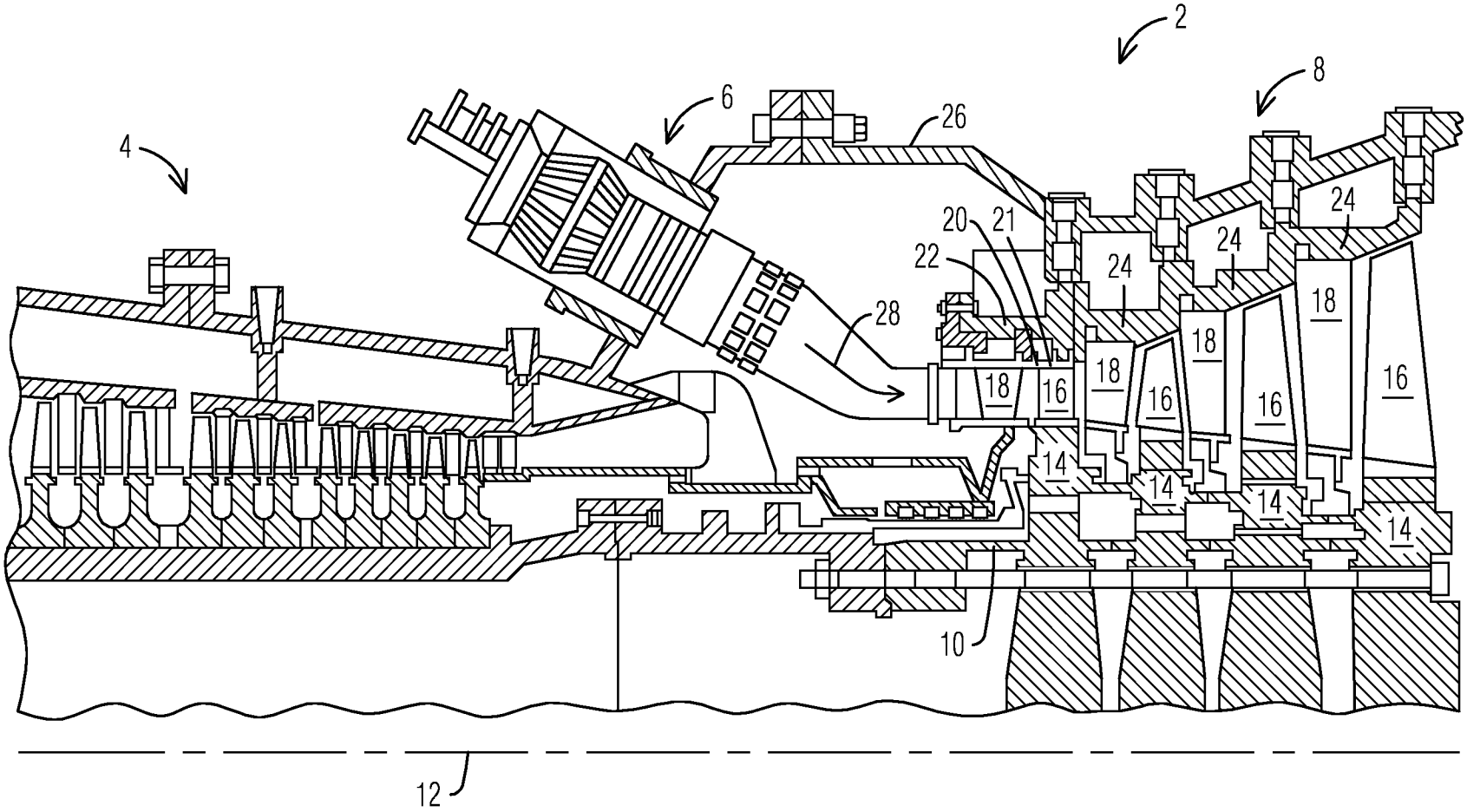
FIG. 1 illustrates a gas turbine engine having one or more hybrid components according to an aspect of the present invention.

Now referring to the figures, FIG. 1 illustrates a gas turbine engine 2 having a compressor section 4, a combustor section 6, and a turbine section 8. In the turbine section 8, there are alternating rows of stationary airfoils 18 (commonly referred to as "vanes") and rotating airfoils 16 (commonly referred to as "blades"). Each row of blades 16 is formed by a circular array of airfoils connected to an attachment disc 14 disposed on a rotor 10 having a rotor axis 12. The blades 16 extend radially outward from the rotor 10 and terminate in blades tips. The vanes 18 extend radially inward from an inner surface of vane carriers 22, 24 which are attached to an outer casing 26 of the engine 2. Between the rows of vanes 18 a ring seal 20 is attached to the inner surface of the vane carrier 22. The ring seal 20 is a stationary component that acts as a hot gas path guide between the rows of vanes 18 at the locations of the rotating blades 16. The ring seal 20 is commonly formed by a plurality of ring segments 21 that are attached either directly to the vane carriers 22, 24 or indirectly such as by attachment to metal isolation rings (not shown) attached to the vane carriers 22, 24. During engine operation, high-temperature/high-velocity gases 28 flow primarily axially with respect to the rotor axis 12 through the rows of vanes 18 and blades 16 in the turbine section 8.

Figure 2:
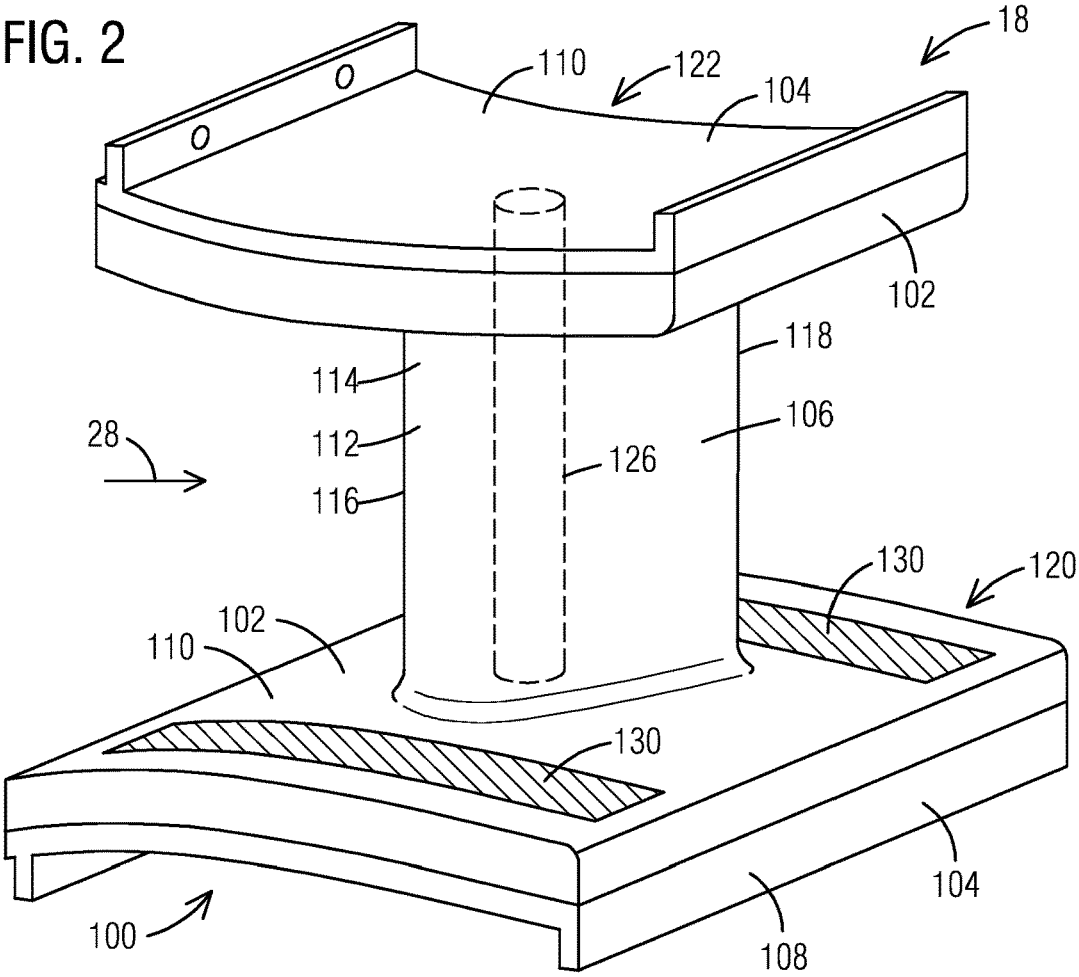
FIG. 2 illustrates an isometric view of a turbine vane including inner and outer shrouds according to an aspect of the present invention.

Referring now to FIG. 2, an isometric view of a turbine vane having an inner and outer shroud is shown. In an embodiment, the vane 18 includes an airfoil 106 located between an inner shroud 120 and an outer shroud 122. The inner and outer shrouds for transitioning of the airfoil 106 to either or both of the platforms 108, 110. The body of the airfoil 106 may include a CMC material 114 defined between a leading edge 116 and a trailing edge 118. In certain embodiments, the airfoil 106 comprises a CMC material having an underlying metal spar 126 that extends through the body of the airfoil 106 between the inner and outer shrouds 120, 122. Each of the inner shroud 120 and outer shroud 122 may comprise a hybrid structure comprising a first component 102 attached to a second component 104 in an attachment arrangement 100 according to an aspect of the present invention. In this embodiment, the first component 102 may be an overlying protective CMC structure covering the second component 104 which may be an underlying metallic substructure. Thus, for this embodiment, the second component 104 has a greater coefficient of thermal expansion relative to the first component 102. As shown, the first component 102 is exposed to the hot gas path 28 while the second component 104 is not exposed to the hot gas path 28. As CMC materials have higher temperature resistance than metallic structures do, they typically perform better in the hot gas path 28.

Figure 3:
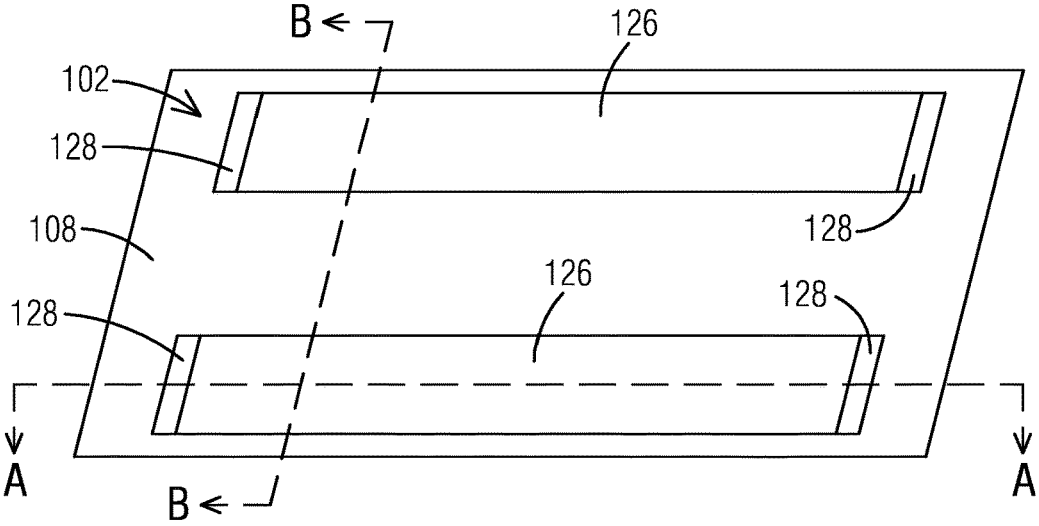
FIG. 3 illustrates a plan view of a first component having recesses and slots for attachment to a second component according to an aspect of the present invention.

In an embodiment, in order to attach the first component 102 to the second component 104, a continuous strap 130 comprising a CMC material may be utilized. FIG. 3 illustrates a plan view of a first component 102. In an embodiment, the surface of the first component 102 includes a plurality of recesses 126 to accommodate the thickness of the continuous CMC strap 130. In an embodiment, the depth d of the recess 126 accommodates the thickness of the CMC strap 130 so that when the length CMC strap 130 is disposed in the recess 126, the CMC strap 130 sits flush with the remaining surface of the first component 102. A plurality of slots 128 may also exist through which end portions of the CMC strap 130 are inserted for attachment to the second component 104. The location and the geometry of the slots 128 and the recesses 126 maybe be changed as required to accommodate an airfoil 106. Dimensions of the CMC strap 130, such as length, width, and thickness, may depend on the specific characteristics of the first component 102 and the second component 104 and as such may be determined in the design process.

Figure 6:
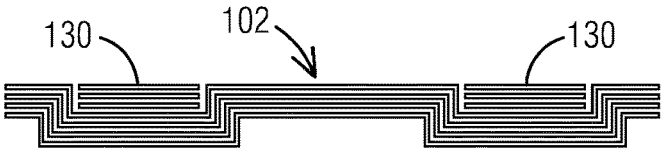
FIG. 6 illustrates a side view through Section B-B of FIG. 3 of an alternate embodiment of the first component.

In an embodiment, the recesses 126 may be formed by machining. Alternately, the recesses 126 may be molded rather than machined. FIG. 6 illustrates a section through the first component 102, Section B-B of FIG. 3, whereby the recesses 126 for the straps 130 have been molded. The advantage of molding the first component 102 with a recess 126 when the material of the first component is a CMC material comprising plies is that the ply ends on the hot gas path 28 are minimized.

Figure 4:
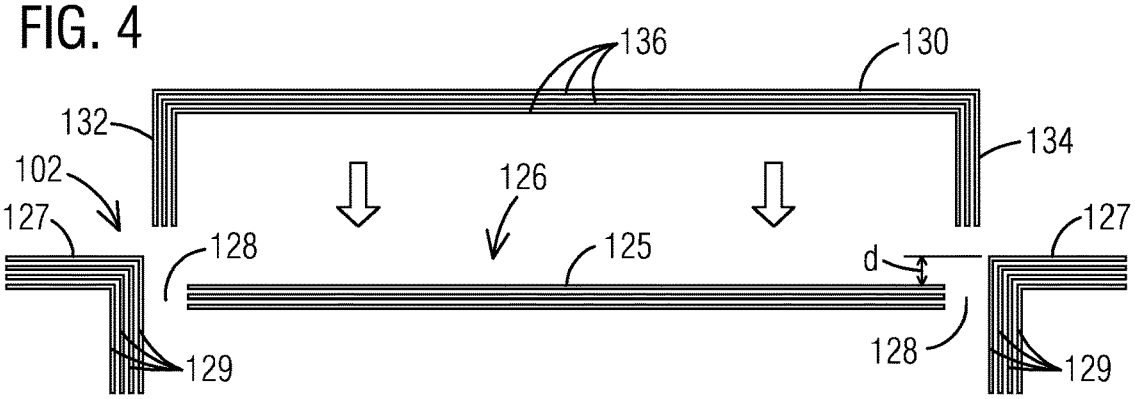
FIG. 4 illustrates a side view of CMC strap and a first component prior to assembly.

Referring now to FIG. 4, a side view of a CMC strap 130 and the first component 102 prior to assembly is illustrated. The first component 102 is illustrated having a surface comprising at least one recessed surface portion 125 and a remaining surface portion 127 as described above. The recess 126 may be a depth (d) from the remaining surface portion 127 in order to accommodate a thickness of the CMC strap 130. In an embodiment, the first component 102 may comprise a CMC material formed of a plurality of plies 129. The surface 127 may also include a plurality of slots 128 configured to accommodate the thickness of the CMC strap 130. In an embodiment, the CMC material of the first component 102 may be the same CMC material as the CMC strap 130. Thus, the CMC strap 130 may also be formed of a plurality of plies 136. The CMC strap 130 may include two end portions, a first end 132 and a second end 134. The length of each end portion 132, 134 may be determined by the distance between the outer surface of the CMC strap 130 to an attachment point with the second component 104. A location of the attachment point may be determined during a design phase. At the attachment point, the CMC strap 130 may be attached to the second component 104 utilizing a securing means such as by pinning, bolting, or clamping.

Figure 5:
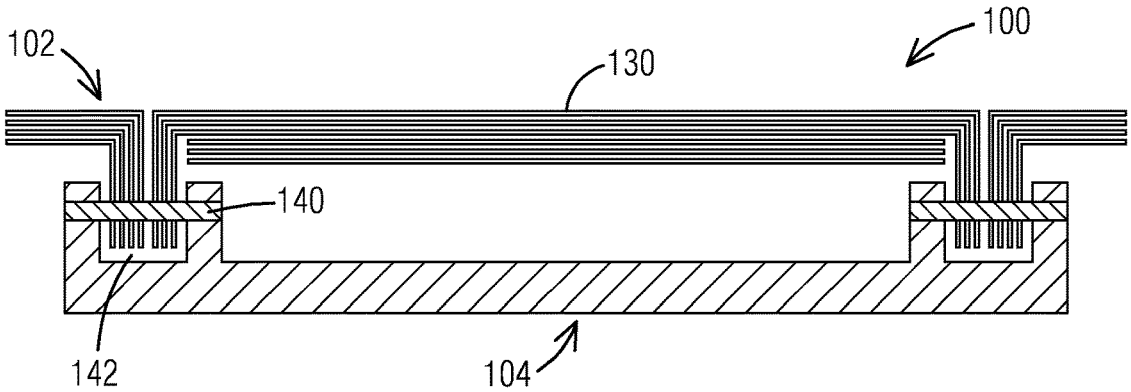
FIG. 5 illustrates side view through Section A-A of FIG. 3 of an embodiment of an attachment arrangement between a first component and a second component utilizing a CMC strap.

Referring to FIGS. 4-5, a method for attaching the first component 102 comprising a ceramic matrix composite (CMC) component to a second component 104 comprising a metallic support structure is presented. In an embodiment, the CMC strap 130 is positioned so that each end portion 132, 134 may be inserted into a respective slot 128 within the first component 102, as shown in FIG. 4. Referring now to FIG. 5, an attachment arrangement 100 is shown with a CMC strap 130 securing the first component 102 to the second component 104. The second component 104 may also include a plurality of slots 142, as shown in FIG. 5, so that each second slot 142 substantially lines up with a first slot 128 whereby the end portion 132, 134 of the strap 130 continues from the first slot 128 through the second slot 142 to an attachment point. Once the end portion 132 reaches the attachment point, it may be secured to the second component 104 by a fastening means 140 such as a bolt, pin, or other suitable fastening structure. The bolt or pin 140 may extend from a wall of the second slot 142 within the second component 104 through the plies of the end portion 132 and into an opposite side wall of the second slot 142. The bolt or pin 140 may be secured to the opposite wall by securing means such as a nut. FIG. 5 illustrates a view of through Section A-A of FIG. 3 after assembly of the CMC strap 130 securing the CMC component 102 to an underlying metallic support structure 104.

Figure 7:
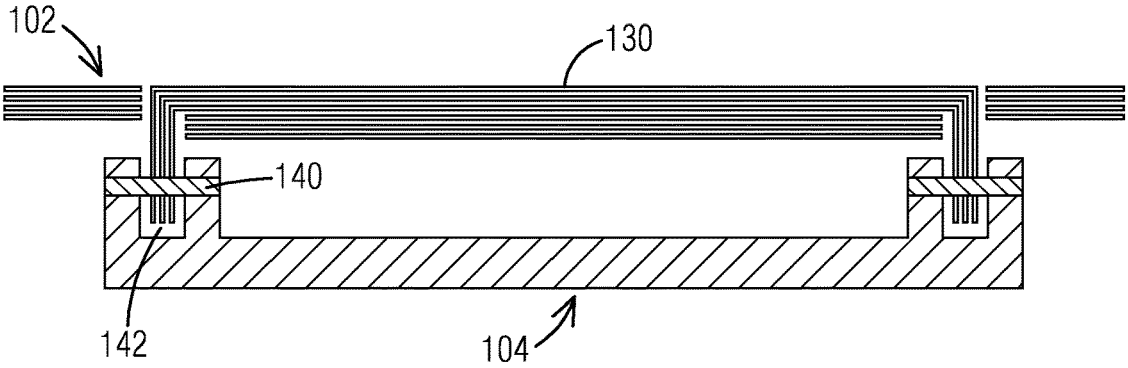
FIG. 7 illustrates a side view through Section A-A of FIG. 3 of an alternate embodiment of a CMC strap securing a first component to a second component.

An outer surface 127 of the first component 102 may include an edge at the point where the slot 128 is formed in the body of the component 102. In the embodiment of the first component 102 comprising a CMC material including a plurality of plies, some of the plies comprising a plurality of surface plies of the first component adjacent to the slot 128 may wrap around a respective edge and extend into the slot 128. This embodiment may be seen in FIGS. 4 and 5 where the surface plies 129 of the first component 102 turn a corner at the slot 128 and extend through the slot 128. The advantage of wrapping the surface plies 129 around the edge and into the slot 128 is that the ply ends are not exposed to the hot gas path 28 thus preventing or minimizing delamination of the ply ends. Additionally, the plurality of surface plies 129 may extend through the first slot 128 and into the second slot 142 as shown in FIG. 5. In this embodiment, the bolt or pin 140 may extend from a wall of the second slot 142 within the second component 104 through surface plies 129, through the plies 136 of the end portion 132, 134 of the CMC strap 130 and into an opposite side wall of the second slot 142. Alternately, the ply ends 129 may terminate at the slot 128 and do not extend into the slot 128 as seen in FIG. 7. This configuration may be easier to manufacture, as the recess 126 and slots 128 may be machined into the shrouds 120, 122 prior to assembly with the CMC straps 130.

In an embodiment, the first component 102 may be a ceramic composite material. The CMC material may be an oxide-oxide (oxide fibers and oxide matrix) CMC material. Alternately, the CMC material may be a silicon carbide-silicon carbide CMC material. The CMC material may provide a hybrid component, such as the first component 102 described in this disclosure, with better thermal insulation than if the component solely comprises a metallic structure. Additionally, the CMC material may comprise either a two-dimensional (2D) or a three-dimensional (3D) lay-up. 2D CMC structures include ceramic fibers spanning in a single plane (x and y directions) while 3D CMC structures also include ceramic fibers spanning directions outside of the single plane (z direction).

The second component 104 may comprise any suitable material for the intended purpose. In certain embodiments, the second component 104 comprises a metallic material. In particular, the second component 104 comprises a superalloy material such as IN738, IN939, or CM247LC. The term superalloy may be understood to refer to a highly corrosion-resistant and oxidation-resistant alloy that exhibits excellent mechanical strength and resistance to creep even at high temperatures. In other embodiments, a suitable material for the second component may include a steel.

An advantage of utilizing CMC straps to secure a CMC structure to a metallic substructure is that the CMC straps utilize the strength of the ceramic fiber instead of the weaker strength CMC matrix. Additionally, when the CMC straps secure a hybrid gas turbine component such as a shroud which is exposed to the hot gas path, no metallic materials are exposed to the hot gas path.

Throughout the disclosure, the referred to first component and second component form an inner or outer shroud of a turbine vane. It is understood that the first component and the second component may belong to other hybrid structures other than a shroud of a gas turbine vane. For example, the hybrid structure may be a turbine vane, turbine blade, or a ring segment in a turbine engine. Additionally, the first component and second component may be any hybrid structure, especially those where the first component and second component have different coefficients of thermal expansion.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A method for attaching a first component comprising a ceramic matrix composite (CMC) component to a second component comprising a metallic support structure, comprising: providing a continuous CMC strap having at least two ends, a first end and a second end; providing the first component having at least two first slots, each slot corresponding to an end of the at least two ends, each slot formed within a body of the first component and configured to accommodate a thickness of the continuous CMC strap; inserting each of the first end and the second end of the CMC strap within respective first slots, a first end into a first slot and a second end into a further first slot; inserting the at least two ends into respective second slots within a second component, the first end into a second slot and the second end into a further second slot, to a respective attachment point with the second component; and securing the at least two ends of the CMC strap to the second component securing the first component to the second component 104.

2. The method as claimed in claim 1, wherein the securing is accomplished utilizing a fastening means so that it extends from a wall of the second slot through the respective end of the CMC strap and into an opposite wall of the second slot.

3. The method as claimed in claim 2, wherein ceramic matrix composite of the first component comprises a first plurality of plies, and wherein the CMC strap includes a second plurality of plies.

4. The method as claimed in claim 3, wherein the first component further comprises an edge formed at the first slot, and wherein a plurality of surface plies of the plurality of plies wrap around the edge and extend into the first slot to prevent delamination of the surface plies.

5. The method as claimed in claim 4, wherein the securing further includes securing the surface plies of the first component within the second slot so the fastening means extends from the wall of the second slot through the plurality of surface plies, through the ends of the CMC strap and into the opposite wall of the second slot.

6. The method as claimed in claim 1, wherein an outer surface of the first component between the at least two slots includes at least one recess so that the outer surface comprises a recessed surface and a remaining outer surface, the recess including a depth equal to the thickness of the CMC strap so that the inserted strap lies flush with the remaining outer surface of the first component.

7. The method as claimed in claim 6, wherein the at least one recess is machined into the outer surface.

8. The method as claimed in claim 6, wherein the at least one recess is created by molding the first component including the at least one recess.

9. The method as claimed in claim 1, wherein the secured first and second components form a component selected from the group consisting of an inner shroud, an outer shroud, a ring segment, and an airfoil of a gas turbine engine.

10. An attachment arrangement between a first turbine component and a second turbine component, comprising: a first turbine component; a second turbine component having a greater coefficient of thermal expansion relative to the first turbine component; and a continuous strap including at least two ends and having the same coefficient of thermal expansion as the first component, wherein each of the at least two ends are retained within a respective first slot in the first turbine component and within a respective second slot in the second turbine component securing the first turbine component to the second turbine component; wherein the first turbine component and the continuous strap comprise the same CMC material.

11. The attachment arrangement as claimed in claim 10, wherein the CMC material is an oxide-oxide CMC material.

12. The attachment arrangement as claimed in claim 10, wherein the second component comprises a superalloy material.

13. The attachment arrangement as claimed in claim 10, wherein an outer surface of the first turbine component further comprises a recess configured to accommodate a thickness of the continuous strap, wherein the outer surface includes a recessed surface and a remaining outer surface.

14. The attachment arrangement as claimed in claim 13, wherein a depth of the recess equals the thickness of the strap so that the outer surface of the strap lies flush with the remaining outer surface of the first turbine component.

15. The attachment arrangement as claimed in claim 10, wherein the CMC material comprises a plurality of plies.

16. The attachment arrangement as claimed in claim 10, wherein the first turbine component further comprising an edge formed at the first slot, wherein a plurality of surface plies of the plurality of plies of the first component wrap around the edge extending into the first slot to prevent delamination of the plies.

17. The attachment arrangement as claimed in claim 10, wherein the arrangement comprises a gas turbine component selected from group consisting of an inner shroud, an outer shroud, a ring segment, and an airfoil of a gas turbine engine.

18. An attachment method, comprising: providing a continuous strap comprising a CMC material having at least two ends, a first end and a second end for attaching a first component to a second component; inserting each of the first end and the second end of the continuous strap within respective slots in the first component, the first end into a first slot and a second end into a further first slot; inserting each of the inserted first end and inserted second end further into respective second slots within the second component until the first end and second end reach respective attachment points within the second component; securing the first end and the second end to the second component with a fastening means; wherein the second component has a greater coefficient of thermal expansion relative to the first component.

19. The attachment method of claim 18, wherein the first component comprises a CMC material and the second component comprises a metallic material.

* * * * *